United States Patent [19]

Palmer, III

[11] Patent Number: 4,501,377

[45] Date of Patent: Feb. 26, 1985

[54] MANHOLE COVER AND ASSEMBLY FOR TANK FOR TRANSPORTING FLAMMABLE LIQUIDS

[76] Inventor: Donald F. Palmer, III, 443 Irvington Rd., Drexel Hill, Pa. 19026

[21] Appl. No.: 557,118

[22] Filed: Dec. 1, 1983

[51] Int. Cl.[3] ..... B65D 45/28

[52] U.S. Cl. ..... 220/314; 220/203; 220/206; 105/377

[58] Field of Search ..... 220/314, 203, 206, 324, 220/334, 378; 292/251.5; 105/377; 137/43, 493

[56] References Cited

U.S. PATENT DOCUMENTS 3,339,791 9/1967 De Frees ..... 220/314

4,181,238 1/1980 Arnold et al. ..... 220/314

*Primary Examiner*—George T. Hall

*Attorney, Agent, or Firm*—Paul & Paul

[57] ABSTRACT

A manhole cover for a mobile tank for transporting flammable liquids is provided with a piston cylinder having a spring-biased ball valve having upper and lower seats. The lower seat is slotted to allow flow of non-compressible liquid in both directions when the ball is seated on the lower seat, thereby to allow the cylinder to move in both directions. The cylinder is attached to the manhole cover which lifts to a limited extent and allows venting in response to fluid pressure rise in the tank. Following venting, the manhole cover and the cylinder return downwardly to their initial positions. In the event of a sudden large surge in fluid pressure, due to tank roll-over or other emergency conditions, the force of the ball spring is overcome and permits the ball to seat on the upper seat, thereby stoppping the flow of liquid, thereby preventing upward movement of the piston cylinder, thereby preventing lifting of the manhole cover.

12 Claims, 3 Drawing Figures

MANHOLE COVER AND ASSEMBLY FOR TANK FOR TRANSPORTING FLAMMABLE LIQUIDS

BACKGROUND OF THE INVENTION

This device relates to a manhole cover for tanks and containers which hold flammable liquids and are mounted upon vehicles for the purpose of transporting such liquid cargo.

Tanks for storage and transport of volatile and flammable liquids, such as gasoline, contain manhole covers for filling and for interior access. Such tanks and containers are provided with conventional vents through which fumes and vapors which normally accumulate within the tank can escape to atmosphere and thereby prevent build-up of excessive pressure in the tank. Failure to provide such venting can result in dangerous pressure build-up and a possible explosive condition. However, in the event of fire or sudden temperature elevation, such conventional vents do not provide sufficient relief for rapid temperature increases, and "emergency venting" is required.

In the prior art, such emergency venting has been accomplished in various ways. In U.S. Pat. No. 3,292,814 to Howard Krone, the cover of the manhole is mounted on a hinged yoke. The yoke and latch are fusibly mounted to a coverplate. The fusing alloy has a melting point such that the pressure of excessive heat will melt the alloy, thereby releasing the yoke and cover to permit emergency venting.

In U.S. Pat. No. 3,179,285 to John DeFrees, the cover itself is fusibly mounted on the yoke.

A disadvantage of fusible emergency venting is the possible absence of sufficient temperature in the immediate proximity to the fusible alloy to cause melting. Another disadvantage is that, once the fusibly alloy has melted, the venting device cannot return to a seated position, and flammable product continues to flow from the manhole.

Another means of emergency venting, as shown in U.S. Pat. No. 3,339,791 to DeFrees, depends upon a spring-mounted cover. When internal tank pressure reaches a predetermined level sufficient to overcome the pre-loaded spring force, the cover will unseat and effect emergency venting. When excess pressure subsides, the spring will force the cover back into a seated position.

The major disadvantage of pressure actuated venting arises in situations of tank overturn. At impact, a pressure surge generated by the liquid cargo against the cover far exceeds the pressure necessary to vent the cover. Such excess pressure forces volatile and combustible product through the restricted opening of the partially unseated cover and creates an outwardly expanding cloud of volatile mist. Any flame or spark in the vicinity of the cloud could cause ignition and a resulting fire.

Another disadvantage of prior manhole covers is the sealing arrangement between the coverplate and collar which extends upward from the tank. Frequently, a flat seal is interposed between them and depends on the clamping force of a circumferential ring to effect sealing. Such a sealing method has been demonstrated to be unreliable in overturn accidents, permitting leakage of flammable product past the seal and into the environment.

SUMMARY OF THE INVENTION

It is, therefore, a principal object of the present invention to provide a manhole cover for a tank for transporting flammable liquids which will function to provide pressure-reducing venting during normal build-up of fluid pressure in the tank but which is restricted from opening during impact conditions.

Another object is to provide a pressure responsive seal around the coverplate which does not depend on clamping force but on pressure from the contained fluid. As the pressure increases, the sealing force also increases.

These and other objects of the present invention will become apparent to those skilled in the art as the description hereof proceeds.

DETAILED DESCRIPTION OF THE PREFERRED EMBODIMENT

Figure 1:
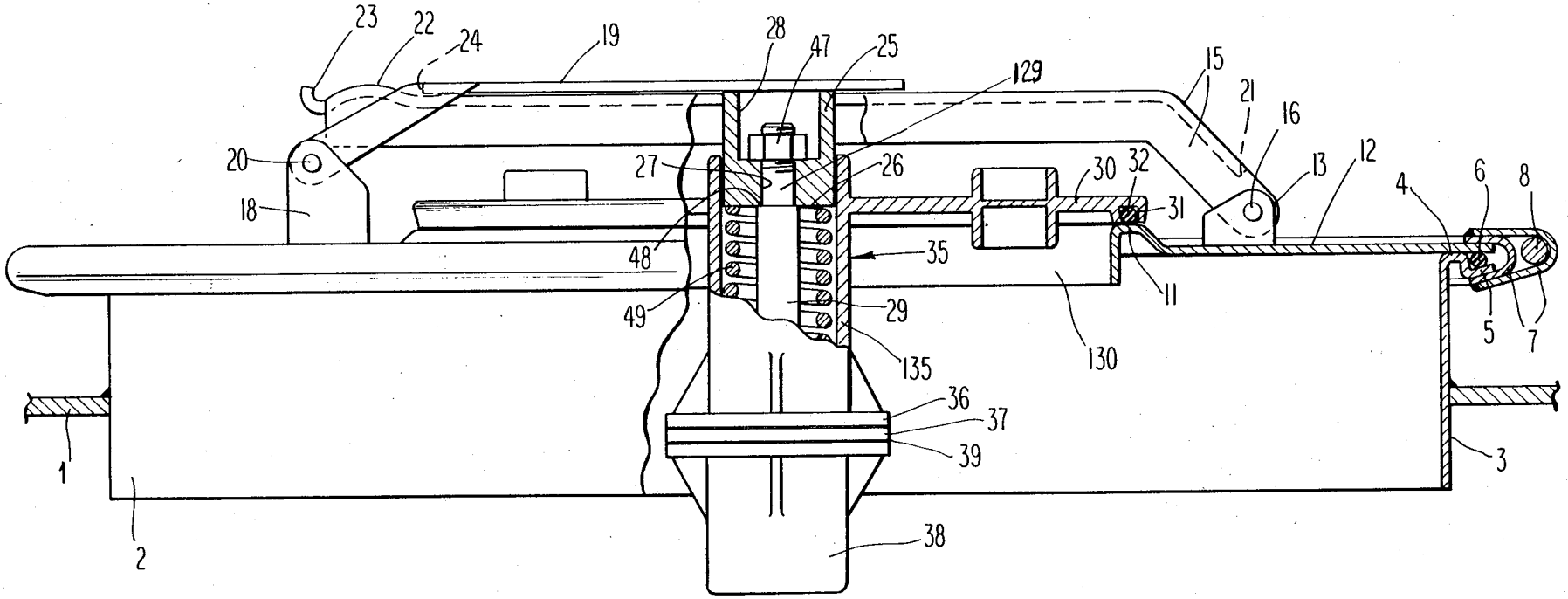
FIG. 1 is a sectional elevation of the manhole cover.
Figure 2:
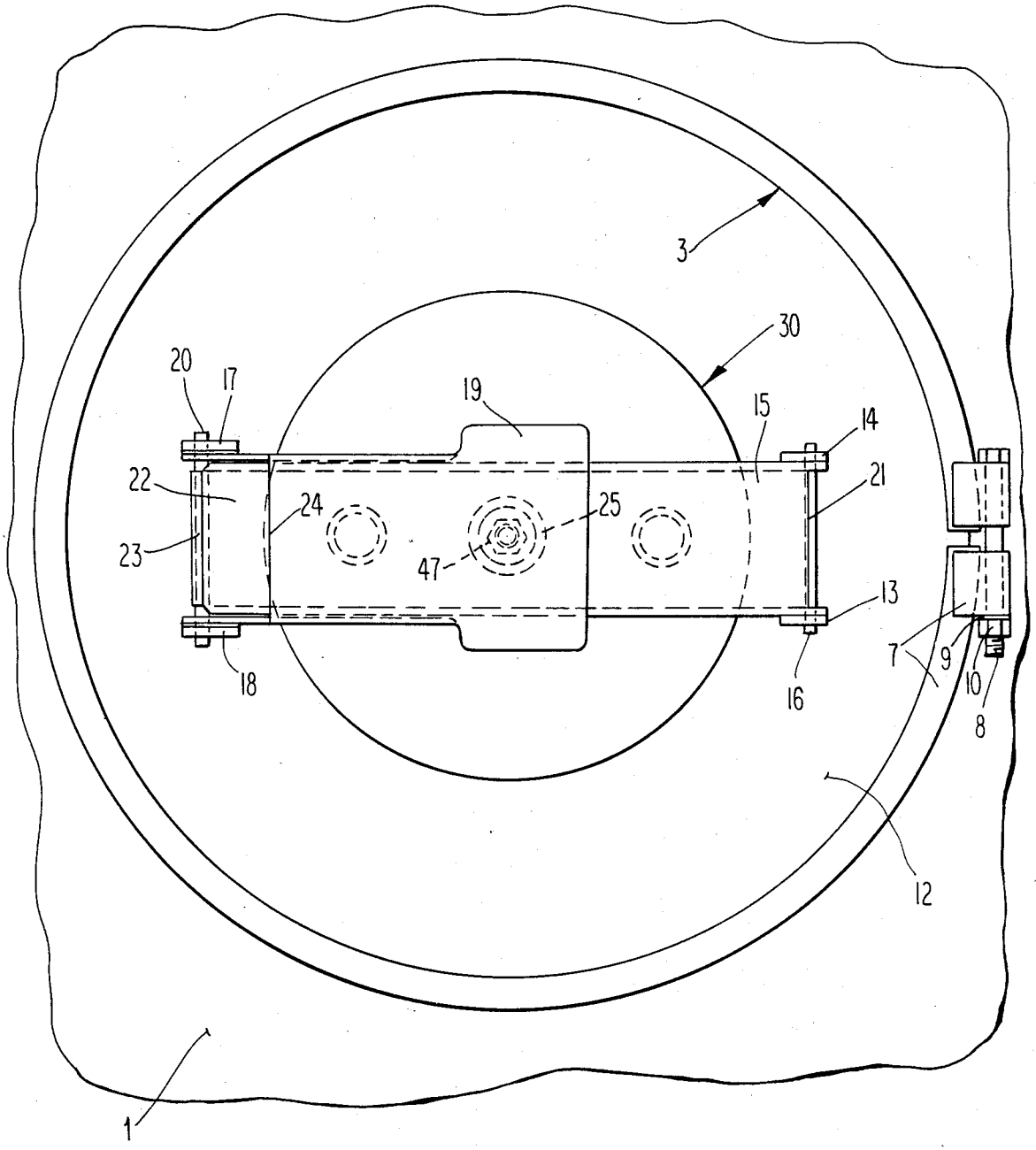
FIG. 2 is a plan view of the cover.

Tank shell 1 has an opening 2 therethrough and an annular vertically disposed collar 3 attached to that part of the shell which defines the opening. The upper edge of collar 3 is provided with an exterior flange 4 the periphery of which forms a dovetail section 5 which contains a seal 6. Seal 6 is of circular cross section and, when installed, is under slight compression between a coverplate 12 and dovetail section 5. Pressure from the tank will tend to force seal 6 outwardly against the taper 5 of the collar flange, thus effecting an ever-tightening seal.

Coverplate 12 is a circular plate which is positioned upon flange 4. Coverplate 12 is secured to collar 3 by a circular clamp 7, in combination with a bolt 8, washer 9, and nut 10, which engages the ends of the clamp. Coverplate 12 has a raised circular seat 11 located radially interior from clamp 7. Seat 11 defines an aperture 130 into the tank.

Mounted upon coverplate 12 is a pair of vertical lugs 13 and 14 which support a yoke 15 upon a pivot pin 16. Yoke 15 extends horizontally across aperture 130 and is swingable about pivot pin 16 to a past-vertical position whereat it does not project over aperture 130.

Diametrally opposite lugs 13 and 14 on coverplate 12 are vertical lugs 17 and 18 which support a latch 19 on a pivot pin 20. Latch 19 has a flat-plate portion 119 which is in alignment with a flat-plate portion 115 of yoke 15 when both are horizontally disposed with latch 19 covering yoke 15. At each side of yoke 15 is a depending shoulder 21. Extending toward the outer end of yoke 15 from shoulder 21 is a raised curved segment 22 which functions as a cam. The inner edge 24 of latch 19 engages cam 22 during closure to secure the cover in a closed position. Yoke 15 outwardly terminates in an up-turned lip 23. As latch 19 is opened, residual pressure in the tank may force the manhole cover 30 suddenly open. In this event, edge 24 of latch 19 will engage lip 23 and prevent further opening of cover 30 until internal tank pressure subsides.

Affixed to the underside of yoke 15 is a sleeve 25 with a flat face 26 on its bottom surface which serves as a spring seat. Bore 27 and counterbore 28 in the upper portion of the sleeve receive a reduced-diameter end 129 of 29.

The manhole cover 30 is a circular structure which is positioned upon seat 11. Cover 30 has a peripheral dovetail-section groove 31 on its underside. Groove 31 contains a rubberlike gasket 32 which is compressed against seat 11 to effect a fluid-tight seal. Gasket 32 is circular in cross-section, and when subjected to pressure from the tank side, will tend to elongate on its vertical axis, thus increasing its sealing pressure. Cover 30 contains a plurality of sleeved bosses 131 which can be machined to accomodate various conventional venting devices as required by a particular application.

Figure 3:
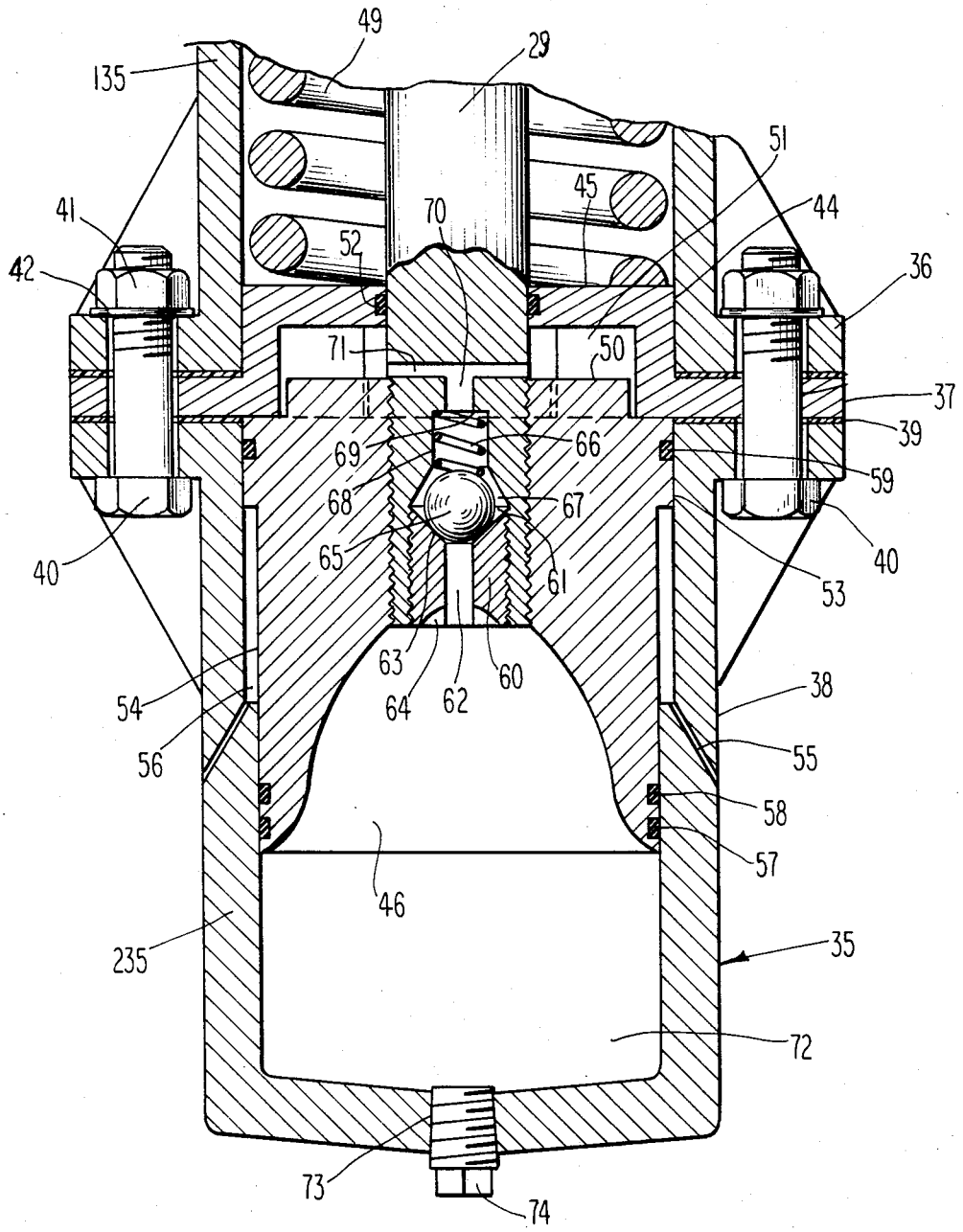
FIG. 3 is an enlarged detailed sectional view of the cylinder assembly.

As seen in FIG. 3, a cylindrical receptacle 135 extends downwardly from the center of cover 30 and also upwardly to slidingly engage sleeve 25 of yoke 15. The lower end of receptacle 135 has an outward flange 36. Positioned below cylindrical receptacle 135 is a lower cylindrical receptacle 235. Interposed between the lower end of receptacle 135 and the upper end of receptacle 235 is an annular cover plate 45 having an outer flange 37.

The upper and lower cylinder receptacles 135, 235 and the annular coverplate 45 are attached together by a plurality of threaded bolts 40 engaging threaded holes, nuts 41, washers 42, and gaskets 39. A shoulder 44 on coverplate 45 engages the interior wall of the lower end of upper receptacle 135. The upper surface of the coverplate 45 functions as a seat for a main compression spring 49.

The upper cylindrical receptacle 135 and the lower cylindrical assembly 235, attached together as shown and described, will be referred to as a unit as cylinder 35.

Disposed within cylinder 35 is a piston 46 which is threadedly connected to the lower end of a shaft 29. Shaft 29 is connected at its upper end to sleeve 25 of yoke 15 by a nut 47. Nut 47, when tightened, draws shoulder 48 of shaft 29 tight against the undersurface 26 of sleeve 25.

During emergency venting, cover 30, cylinder 35 and annular interior coverplate 37 move axially relative to yoke 15, shaft 29, and piston 46. Spring 49 is disposed between upper spring seat 26 and lower spring seat 45, and is preloaded to retain the cover in a seated position until a predetermined pressure in the tank is reached. Under static conditions the spring force of spring 49 maintains piston 46 in the extreme upper portion of lower cylindrical receptacle 235, with the shoulder 146 of the piston abutting against the lower surface of the flange 37 of the interior coverplate 45. A raised hexagonal boss 50 on the top of piston 46 engages a recess 51 of corresponding size and hexagonal shape in the bottom of the cylinder coverplate 45, thereby to prevent relative rotational movement of piston 46 during assembly. Seal 52 provides fluid-tight sealing of the shaft 29 of the piston 46.

The upper portion 53 of piston 46 is of larger diameter than its lower portion 54 to compensate for the area on the upper surface of piston 46 which is subtended by the area of piston shaft 29. Thus, the upper and lower projected areas of piston 46 are equal. The diameter of the bore of the lower cylindrical receptacle 235 is correspondingly stepped to slidingly accomodate the respective piston diameters. A plurality of holes 55 through the cylinder wall allow air to escape from void 56 as the cylinder 35 moves upward relative to piston 46. The holes 55 are downwardly sloping to permit drainage of incidental fluid entering the void 56. Seals 57, 58, and 59 form a pressure-tight seal between the piston 46 and the cylinder bore.

A ball retainer 60 is threadedly retained in a concentrically threaded bore in the lower end of piston shaft 29. The upper surface 61 of ball retainer 60 is of conical concave configuration, the apex of which intersects a bore 62 in the ball retainer 60. A plurality of slotted indentations 63 in the concave surface 61 extend outwardly from the apex to the outer edge of ball retainer 60. A semi-circular slot 64 in the lower end of ball retainer 60 facilitates assembly.

Ball 65 is retained against the concave surface 61 of the ball retainer 60 by a spring 66. Vertically opposite the concave face 61 of the ball retainer 60 is a similarly concave seat 67 which is integral with the piston shaft 29. The apex of the concavity 67 intersects an axial bore 68 which extends upwardly to form a square shoulder 69 which functions as a spring seat. A smaller diameter bore 70 continues upwardly to intersect a cross-bore 71 in shaft 29 located just above the upper surface of the piston boss 50.

The internal volume defined by the cylinder 35 and the cylinder interior coverplate 45 is filled with a noncompressible hydraulic fluid 72.

Under conditions of gradual pressure rise within the tank, the manhole cover 30 will commence venting at about 3 PSIG tank pressure, and begin to rise off of seat 11. As the cover 30 and cylinder 35 move vertically, hydraulic fluid in the upwardly-moving cylinder 35 is forced through bore 62, slots 63, around ball 65, through bores 68 and 70, and through cross-bore 71 to maintain pressure equilibrium on both sides of piston 46. When excess tank pressure has been relieved, the main spring 49 forces coverplate 45 and cylinder 35 back to their initial positions in which coverplate 45 is seated on the shoulder 146 of the piston. During this return movement, the direction of flow of the hydraulic fluid reverses. Thus, under conditions of normal emergency venting, the hydraulic cylinder assembly is passive.

However, under conditions of pressure surge such as occurs at impact during a tank rollover, the pressure rises virtually instantaneously, and attains a magnitude of 10 to 15 PSIG. The force of liquid in the tank impinging on the manhole cover 30 produces a tremendous acceleration force on the cover. Likewise, flow of the hydraulic fluid in the cylinder 35 is accelerated, and with sufficient magnitude to force ball 65 upward, overcoming the resistance of spring 66 and forcing ball 65 against upper seat 67. This terminates any further flow of hydraulic fluid. Hydraulic fluid is thus trapped in the lower portion of the cylinder 35 and retards further movement of the cylinder 35 and cover 30. Ball 65 will remain seated on upper seat 67 as long as the surge pressure exceeds the force of spring 66. When the surge pressure subsides, spring 66 will force the ball 65 back to its static position against the ball retainer 60 and two-way hydraulic flow will resume.

Under pressure surges such as occur during a tank rollover, the hydraulic flow which occurs prior to the ball seating is minimal and results in a very slight vertical displacement of the manhole cover, about one or two thousandths of an inch. Since seal 32 is compressed five to seven thousandths of an inch when the manhole cover is locked closed, there is not sufficient movement to break the seal between the cover 30 and the seat 11.

Aeration of the hydraulic fluid in cylinder 35 could impair the proper functioning of the cylinder assembly during surge conditions. Hence, all contours on the lower side of piston 46 slope upwardly, such that entrapped air will rise upwardly, setling in the upper chamber 51 of the cylinder 35. The air is displaced by fluid from the upper chamber 51 of the cylinder. In this manner, the hydraulic fluid in the upper chamber 51 of the cylinder 35 comprises a reservoir to replace fluid which might, over the years, escape from the lower chamber of the cylinder.

In the event that seal 32 becomes excessively worn, or loses resilience, it is possible that a small amount of liquid product could escape past the cover during impact. To prevent uncontrolled dispersion of the flammable liquid, lips 33 and 34 will deflect the liquid back toward the center of the manhole and along the center of the tank, thereby substantially containing the combustible spray.

What is claimed is:

1. A manhole cover and assembly for a mobile tank for transporting flammable liquids, said cover adapted to provide protection against explosion during emergency conditions, said cover and assembly comprising:

A. means for permitting limited controlled movement of said manhole cover in the opening direction in response to low-rate build-up of fluid pressure in said tank to allow pressure-reducing venting and for returning said cover to fully closed position following venting; and B. means for preventing opening movement of said cover in response to sudden and large pressure surge against said cover resulting from tank roll-over or other emergency conditions;

C. said means for permitting limited controlled movement of said cover is the opening direction in response to low-rate build-up of fluid pressure in said tank indluding:

a. A cylinder connected to said cover and extending downwardly therefrom, said cover having an opening, said cylinder having a closed bottom and an open top and being coaxially aligned with said cover opening;

b. A piston in a lower portion of said cylinder;

c. A first chamber below said piston, said chamber containing non-compressible liquid;

d. An interior cover within and secured to said cylinder above said piston, said interior cover forming a second chamber above said piston;

e. A passageway through said piston providing communication for said liquid between said first and second chambers;

f. A fixed member extending across and above said manhole cover; and g. A main compression spring in said cylinder positioned between said interior cover and said fixed member whereby in response to build-up of fluid pressure in said tank said manhole cover starts to lift thereby pulling up said cylinder and interior cover and compressing said main compression spring, said upward movement of said cylinder causing said liquid to flow through said passageway from said first to said second chamber, said main compression spring returning said cylinder and manhole cover to closed position following reduction in said fluid pressure.

2. A manhole cover and assembly according to claim 1 wherein said means preventing opening movement of said cover comprises;

a. a valve in said passageway; and b. means closing said valve in response to a sudden and large increase in upward pressure on said non-compressible liquid resulting from attempting upward movement of said cylinder in response to attempted lifting of said manhole cover in response to sudden and large pressure surge against said cover.

3. A manhole cover and assembly according to claim 2 wherein:

a. said cylinder extends above said cover forming a collar;

b. said fixed member which extends across and above said manhole cover is a yoke pivotally mounted on said tank at one side of said manhole cover;

c. said yoke has a sleeve secured to its underside and extending downwardly therefrom;

d. said sleeve is positioned to be received in a sliding fit within said cover collar.

4. A manhole cover and assembly according to claim 3 wherein:

a. said yoke sleeve has a small-diameter lower bore and a larger-diameter counterbore thereabove, forming therebetween an annular shoulder;

b. the upper end of said main compression spring seats against the underside of said sleeve.

5. A manhole cover and assembly according to claim 4 wherein:

a. said cylinder contains a piston shaft the lower end of which is connected to said piston and the upper end of which is connected to said yoke sleeve, and b. wherein said interior cover is provided with an aperture through which said piston shaft passes; and c. means sealing the edge of said aperture against passage of fluid.

6. A manhole cover and assembly according to claim 5 wherein said piston shaft has a reduced-diameter upper end which extends through said lower bore and into said counterbore of said yoke sleeve and is secured thereto by a nut which is supported on said shoulder of said sleeve.

7. A manhole cover and assembly according to claim 6 wherein:

a. said valve is a ball;

b. said passageway in said piston is provided with a lower ball seat having slots therein allowing fluid passage when said ball is on said lower seat, an upper ball seat, and a spring seat located above said upper ball seat;

c. a valve compression spring is provided in said passageway between said spring seat and said ball, said valve spring normally maintaining said ball on said lower seat spaced from said upper seat, thereby maintaining said valve normally open to flow of fluid, said valve spring selected to have such force as to be compressed sufficiently to allow said ball to seat on said upper seat, thereby to close said valve, in response to sudden large increase in upward pressure on said non-compressible liquid, thereby to prevent opening of said manhole cover.

8. A manhole cover and assembly according to claim 7 wherein each of said valve seats is concave.

9. A manhole cover and assembly according to claim 8 wherein the undersurface of said piston is upwardly tapered.

10. A manhole cover and assembly on a mobile tank for carrying flammable liquids, said manhole cover and assembly comprising:

a. a coverplate having a raised rim defining an aperture into said tank;
b. a cover positioned and seated on said rim;
c. means sealing against escape of fluid when said cover is on said rim;
d. said cover having an opening on the center axis thereof, said cover opening defined by a collar extending upwardly from said cover;
e. a cylinder coaxial with said cover collar and extending downwardly from said cover, said cylinder having a closed bottom and an open top;
f. a yoke mounted pivotally on said tank outside the periphery of said cover, said yoke extending horizontally across said cover at a spaced distance thereabove;
g. means latching said yoke in horizontal position;
h. a sleeve secured to said yoke and extending downwardly therefrom, said yoke sleeve positioned to be slidingly fitted into said collar when said yoke is pivotally lowered to its horizontal position;
i. said yoke sleeve having a lower center bore and a larger diameter counterbore thereabove, forming an annular shoulder therebetween;
j. a piston in the lower portion of said cylinder;
k. a first chamber below said piston containing non-compressible liquid;
l. an annular interior cover plate within said cylinder positioned at a spaced distance above and forming a second chamber above said piston;
m. a piston shaft having its lower end connected to said piston, said shaft extending upwardly through the opening in said annular interior cover plate, the upper end of said shaft being of reduced diameter and extending through said lower center bore and into said counterbore of said yoke sleeve;
n. a nut threaded on the upper end of said piston shaft and supported on said shoulder of said yoke sleeve, thereby supporting said piston shaft from said yoke;
o. a main compression spring mounted in said cylinder and extending upwardly from said annular interior cover plate to the underside of said yoke sleeve, whereby when said manhole cover lifts in response to increased fluid pressure in said tank, said cylinder moves upwardly against the force exerted by said main compression spring;
p. a passageway in said piston extending therethrough and providing communication for said liquid between said first chamber and said second chamber;
q. a ball valve in said passageway;
r. upper and lower valve seats in said passageway;
s. a spring seat in said passageway above said upper valve seat;
t. valve compression spring means positioned in said passageway between said spring seat and said ball maintaining said ball at spaced distance from said upper valve seat, said valve spring being selected to resist compression in response to low-rate increase in upward pressure applied to said ball by said non-compressible liquid in said first chamber resulting from said upward movement of said manhole cover and cylinder in response to low-rate increase in fluid pressure;
u. said valve spring means being selected to be sufficiently compressed in response to sudden large surge in upward liquid pressure to seat said ball on said upper seat, thereby to prevent flow of said non-compressible liquid through said passageway, thereby to prevent upward movement of said cylinder and manhole cover under impact conditions.

11. A manhole cover and assembly according to claim 10 wherein:
a. said coverplate is supported on a collar having an exterior flange which, together with the peripheral edge of said coverplate forms a dovetail section;
b. an annular seal is installed within said dovetail section, said seal under slight compression at installation; whereby an increase in fluid pressure in said tank will tend to force said seal outward against the tapering surfaces of said dovetail section, thereby to increase the sealing effect of said seal.

12. A manhole cover and assembly according to claim 11, wherein said annular seal is of circular cross-section.

* * * * *